US010818275B2

(12) United States Patent
Ball et al.

(10) Patent No.: US 10,818,275 B2
(45) Date of Patent: Oct. 27, 2020

(54) SYSTEM FOR PREPARING MUSICAL INSTRUMENT STRINGS

(71) Applicant: Ernie Ball, Inc., San Luis Obispo, CA (US)

(72) Inventors: Brian N. Ball, San Luis Obispo, CA (US); James C. Harrington, La Quinta, CA (US)

(73) Assignee: Ernie Ball, Inc., San Luis Obispo, CA (US)

( * ) Notice: Subject to any disclaimer, the term of this patent is extended or adjusted under 35 U.S.C. 154(b) by 0 days.

(21) Appl. No.: 16/295,897

(22) Filed: Mar. 7, 2019

(65) Prior Publication Data

US 2019/0295511 A1 Sep. 26, 2019

Related U.S. Application Data

(60) Provisional application No. 62/642,357, filed on Mar. 13, 2018.

(51) Int. Cl.
*G10D 3/22* (2020.01)
*G10D 3/10* (2006.01)

(52) U.S. Cl.
CPC ..... *G10D 3/22* (2020.02); *G10D 3/10* (2013.01)

(58) Field of Classification Search
CPC ..... G10D 3/22; G10D 3/10; G10D 1/08
See application file for complete search history.

(56) References Cited

U.S. PATENT DOCUMENTS 5,454,525 A * 10/1995 Schamesberger ..... A63B 51/02 242/125.1

* cited by examiner

*Primary Examiner* — Kimberly R Lockett
(74) *Attorney, Agent, or Firm* — Jeffrey G. Sheldon; Katherine B. Sales; Cislo & Thomas LLP

(57) ABSTRACT

A method of treating an instrument string comprising the steps of: (a) securing both ends of the string, while the string is not on an instrument, to an apparatus that can apply tension to the string, the string having a longitudinal axis; (b) applying sufficient tension to the string with the apparatus along the longitudinal axis of the string to elongate the string by at least 0.3% without breaking the string; and (c) releasing at least part of the tension of step (b), wherein at least part of the elongation from step (b) remains.

25 Claims, 8 Drawing Sheets

| | | | | | Stretch Percentages (lbs) | | | | | | |
|---|---|---|---|---|---|---|---|---|---|---|---|
| Type | Set | Gauge | Breaking Load (lbs) | | 20% | 30% | 40% | 50% | 60% | 70% | 80% |
| Metallic Strings | RPS | .010 | 29 | | [illegible] | [illegible] | [illegible] | [illegible] | [illegible] | [illegible] | 23.2 |
| | | .013 | 44 | | [illegible] | [illegible] | [illegible] | 22.0 | 28.4 | 30.8 | 35.2 |
| | | .017 | 70 | | [illegible] | 21.0 | 28.0 | 35.0 | 42.0 | 49.0 | 56 |
| | Standard Plains | .010 | 25 | | [illegible] | [illegible] | [illegible] | [illegible] | 15.0 | 17.5 | 20 |
| | | .013 | 38 | | [illegible] | [illegible] | 15.2 | 19.0 | 22.8 | 26.6 | 30.4 |
| | | .017 | 64 | | [illegible] | 19.2 | 25.6 | 32.0 | 38.4 | 44.8 | 51.2 |
| | Standard Electric Guitar Wounds | .020 (.010hx) | 29 | | [illegible] | [illegible] | [illegible] | [illegible] | [illegible] | [illegible] | 23.2 |
| | | .024 (.013hx) | 45 | | [illegible] | [illegible] | [illegible] | [illegible] | [illegible] | 31.5 | 36 |
| | | .042 (.017hx) | 77 | | [illegible] | [illegible] | [illegible] | 38.5 | 46.2 | 53.9 | 61.6 |
| Non-Metallic Strings | Classical Plains w/ Ball Ends | .028 | 20 | | [illegible] | [illegible] | 8.0 | 10.0 | 12.0 | 14.0 | 16 |
| | | .032 | 20 | | [illegible] | [illegible] | 8.0 | 10.0 | 12.0 | 14.0 | 16 |
| | | .040 | 20 | | [illegible] | [illegible] | 8.0 | 10.0 | 12.0 | 14.0 | 16 |
| | Classical Wounds w/ Ball Ends | .030 | 40 | | [illegible] | 12.0 | 16.0 | 20.0 | 24.0 | 28.0 | 32 |
| | | .036 | 40 | | [illegible] | 12.0 | 16.0 | 20.0 | 24.0 | 28.0 | 32 |
| | | .042 | 40 | | [illegible] | 12.0 | 16.0 | 20.0 | 24.0 | 28.0 | 32 |

Measurable Change

No Change

Figure 6

SYSTEM FOR PREPARING MUSICAL INSTRUMENT STRINGS

CROSS-REFERENCE TO RELATED APPLICATIONS

This application claims the benefit of U.S. Provisional Patent Application No. 62/642,357 filed on Mar. 13, 2018, titled "System for Preparing Musical Instrument Strings," the contents of which are incorporated herein by reference in their entirety.

BACKGROUND

Musical instruments require tuning so that when they are played they are at the right pitch.

SUMMARY

The present invention is directed to a system for treating instrument strings so that they are at least partially tuned before they are placed upon the instrument. This system includes a method of treating the instrument strings and the strings produced by a method. In the method, both ends of the string are secured to an apparatus and tension is applied to the string to stretch the string. This is done while the string is not on an instrument. The string has a longitudinal axis. Sufficient tension is applied to the string with the apparatus along the longitudinal axis to elongate the string by at least 0.3%, and preferably at least 1%, without breaking the string. Then at least a portion of the tension is released, but at least part of the elongation from the tension application step remains. Preferably the tension and release steps are performed at least twice, and typically from two to six times.

The string can or cannot have a retainer such as a ball or loop.

Preferably the tension is applied only along the longitudinal access, and preferably sufficient tension is applied to achieve elongation at a rate of 0.1 to 10 inches per minute, and more preferably at about one inch per minute.

So that some of the elongation remains each time tension is applied, at least 30%, and preferably at least 65%, and most preferably about 80%, of the maximum force achievable before failure of the string is applied. The invention is particularly applicable to metal strings but can also be used with strings made of synthetic material. The string can be a non-wound string having a diameter from 0.007 to 0.026 inch, or a wound string having a diameter of from 0.018 to 0.145 inch.

DRAWINGS AND TABLES

These and other features, aspects, and advantages of the invention will become better understood with reference to the following drawings and tables:

FIG. 6 is a table showing results from testing the present invention;

Figure 7A:
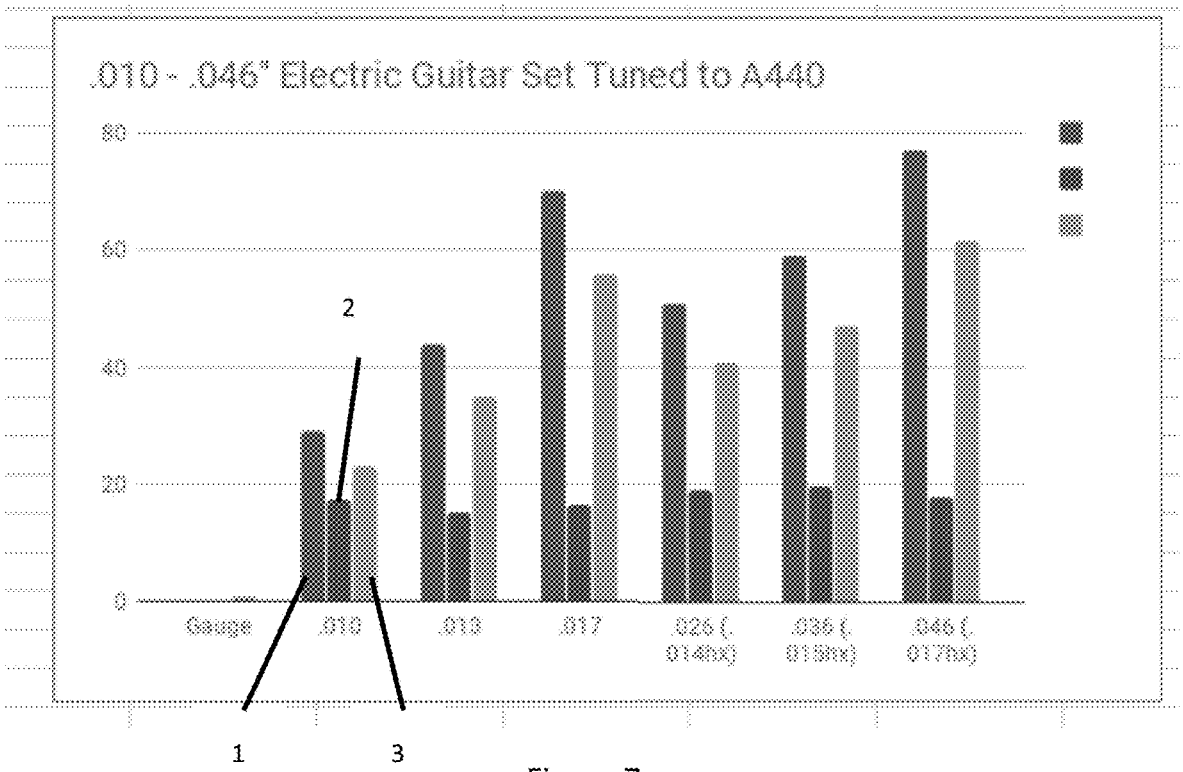
Figure 7B:
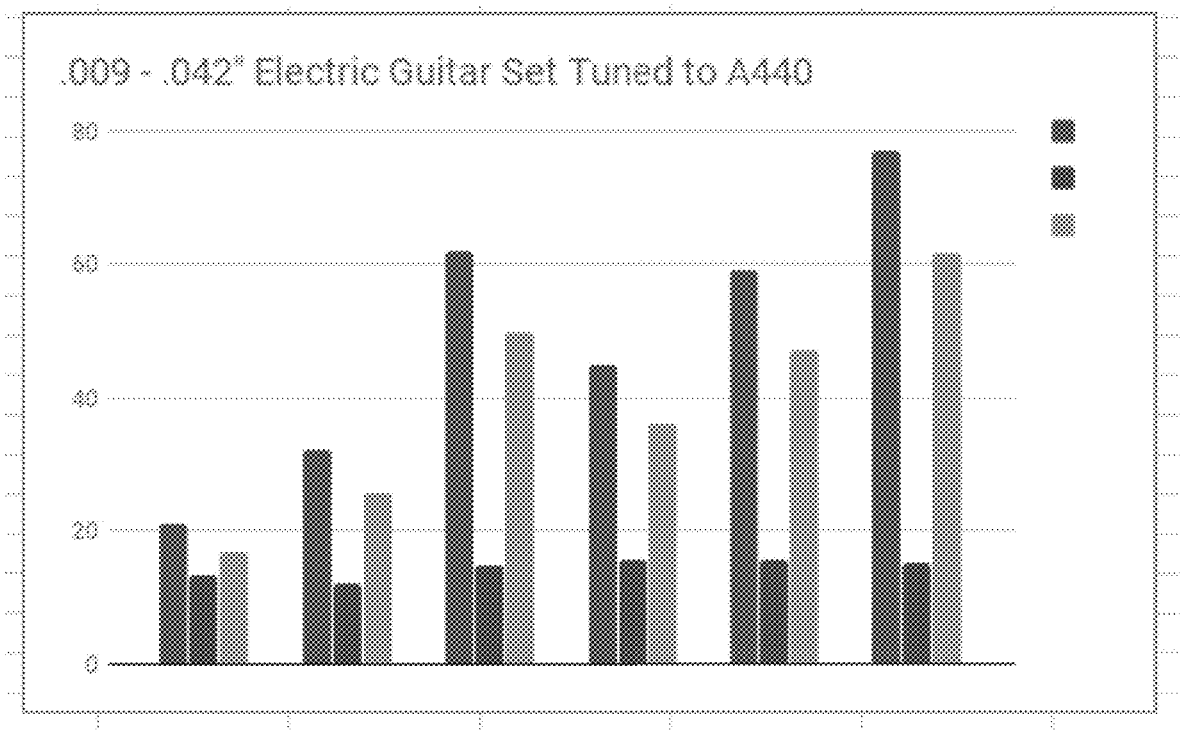
Figure 7C:
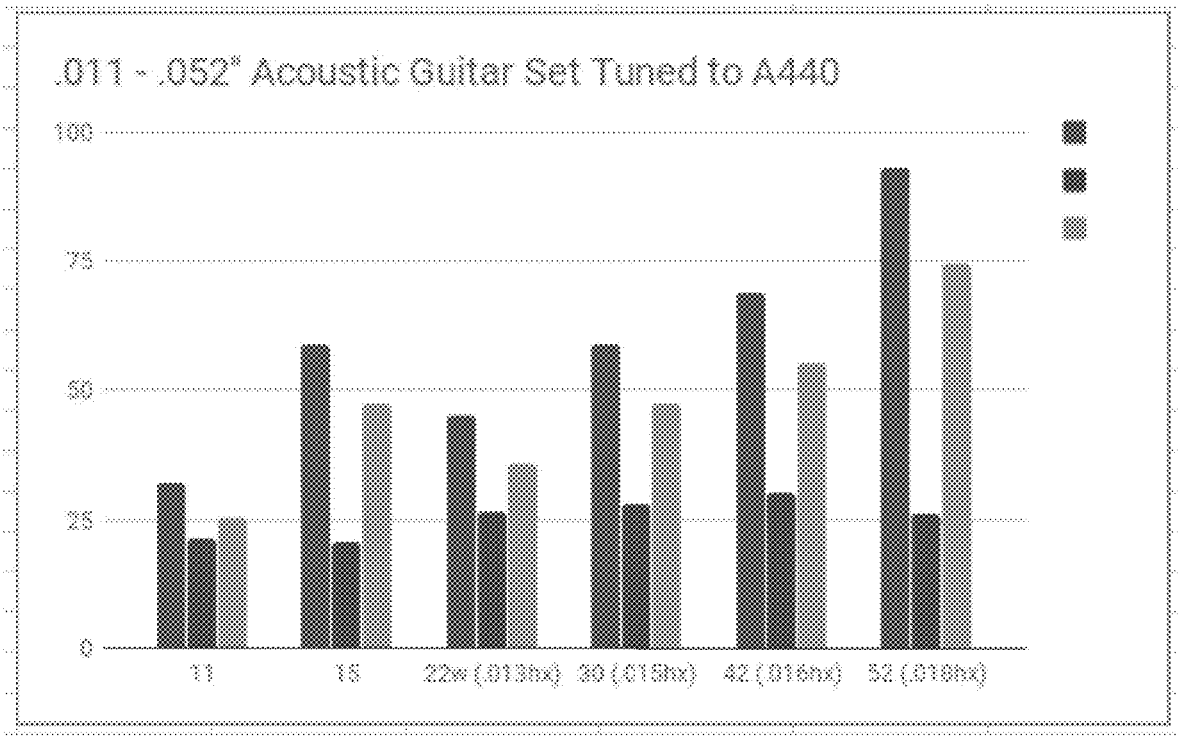
Figure 7D:
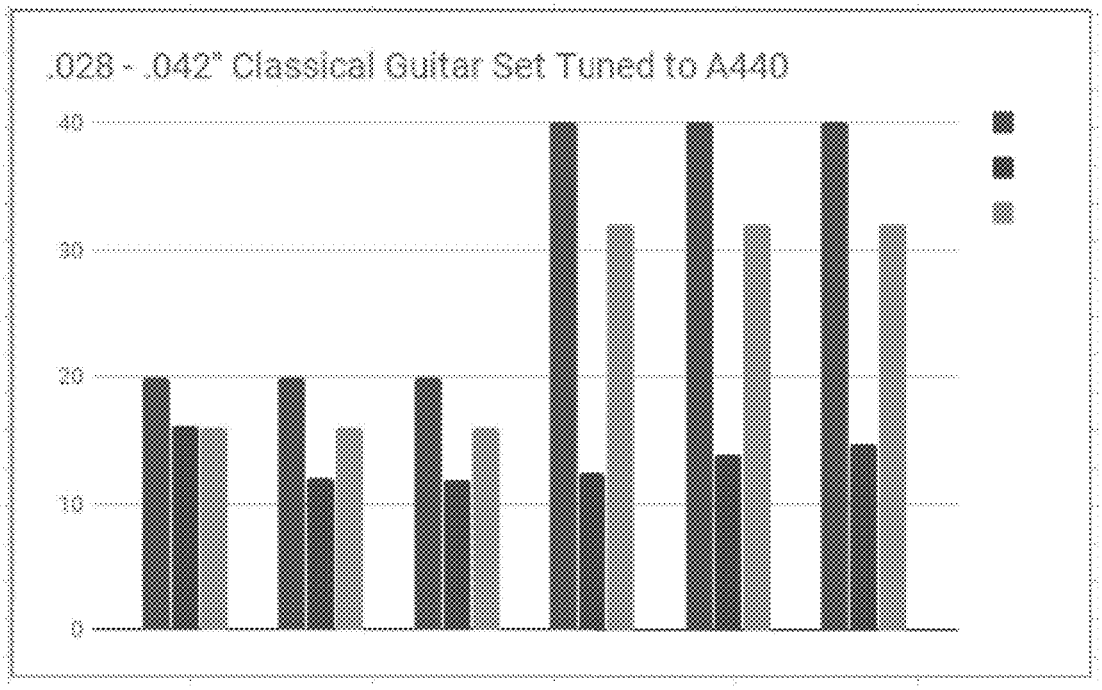
Figure 8A:
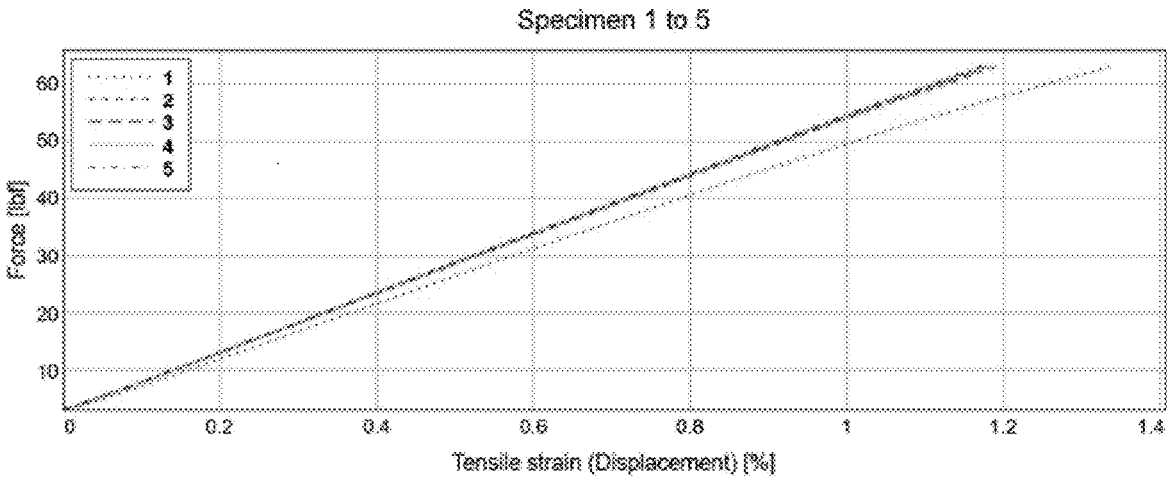
Figure 8B:
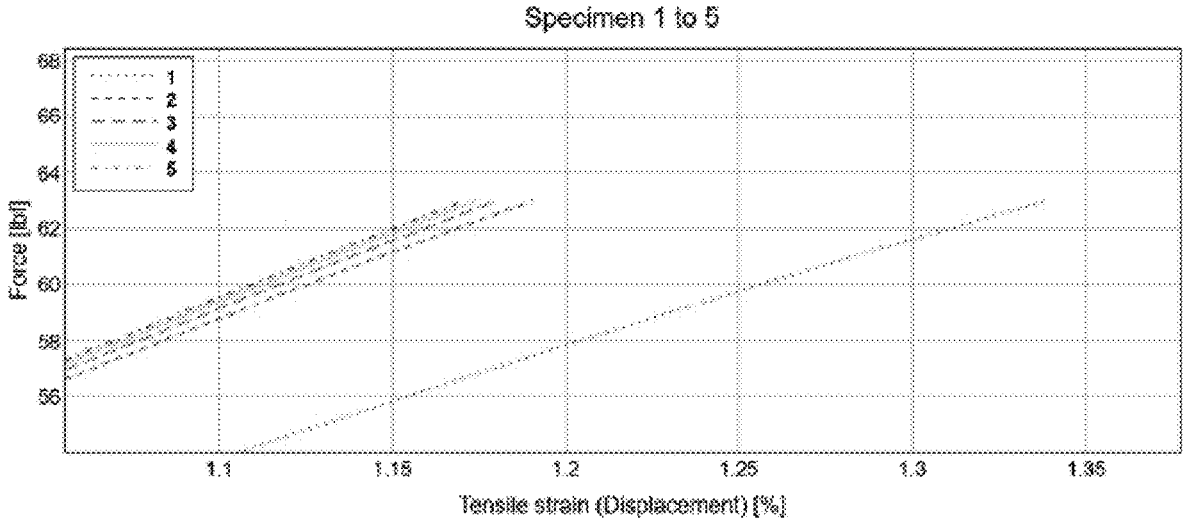

FIG. 7*a* is a graph showing breaking load, tension, and a preferred stretch of 0.01 inch to 0.046 inch gauge electric guitar strings;

FIG. 7*b* is a graph showing breaking load, tension, and a preferred stretch of 0.009 inch to 0.042 inch gauge electric guitar strings;

FIG. 7*c* is a graph showing breaking load, tension, and a preferred stretch of 0.011 inch to 0.052 inch gauge acoustic guitar strings;

FIG. 7*d* is a graph showing breaking load, tension, and a preferred stretch of 0.028 inch to 0.042 inch gauge classical guitar strings;

FIG. 8*a* is a graph showing the results of testing of the present invention; and FIG. 8*b* is a graph showing a detailed view of a section of the graph of FIG. 8*a*.

DESCRIPTION

Figure 1:
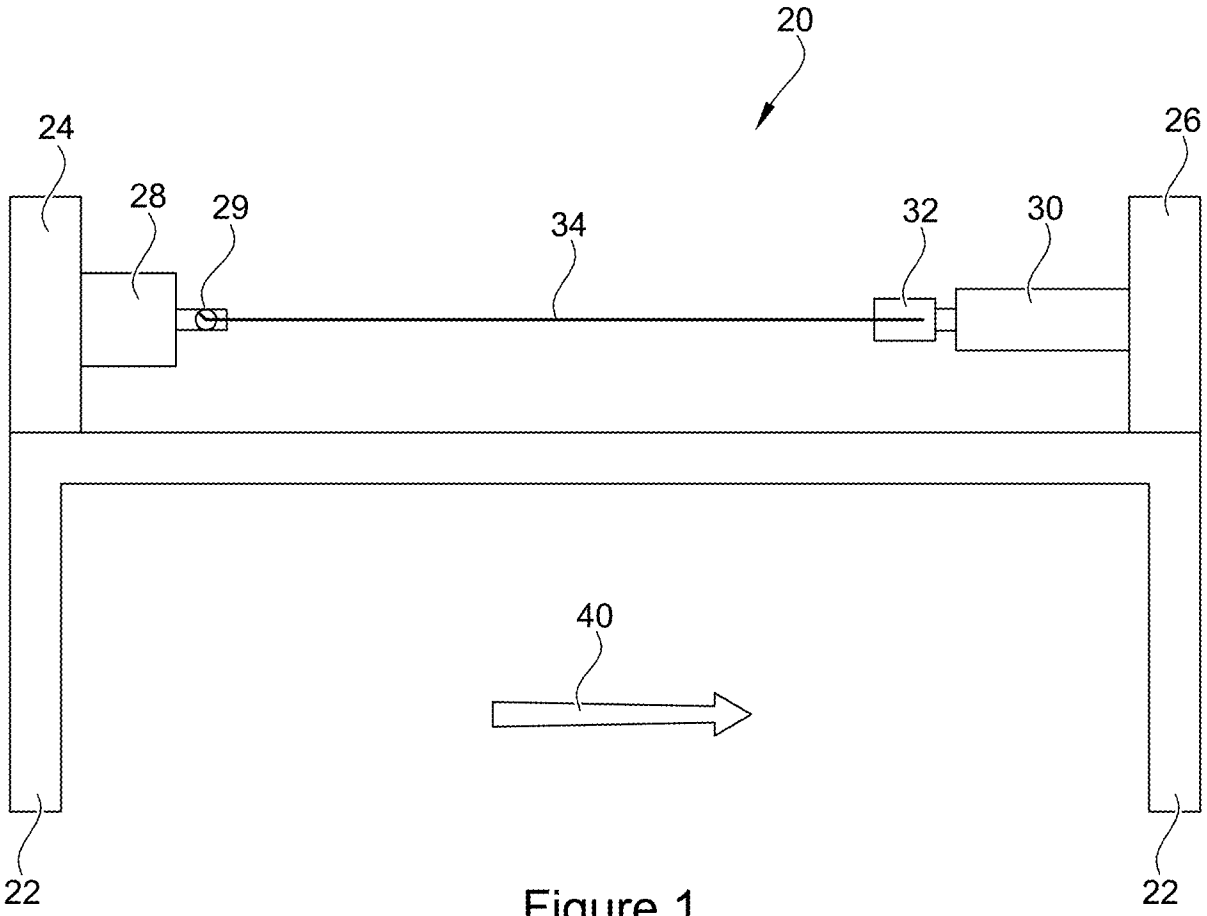
FIG. 1 is a schematic of an apparatus useful for applying tension to a string.

With reference to FIG. 1, an apparatus 20 for practicing the present invention comprises a frame 22 having a left end block 24 and an opposed right end block 26. The left end block 24 supports a force gauge 28 and the right end block 26 supports a linear actuator 30 for applying tension via a chuck 32 to a musical instrument string 34 having as a retainer a ball 36 (see FIG. 2) for engaging the force gauge 28 with a hook 29 secured to the force gauge 28. The other end of the string 34 is engaged by the chuck 32. In use the linear actuator 30 is used to apply tension to the string 34 in a direction shown by arrow 40.

The apparatus 20 can be controlled by a PLC (programmable logic controller) to control the linear actuator 30 using feedback from the force gauge 28 to generate a specific load at a controlled rate. Strings 34 are loaded onto the apparatus 20 by loading the ball end of the string 34 into the hook 29 end shown on the left and the other end of the string 34 loaded into the chuck 32. Once loaded, the apparatus 20 applies the pre-determined tension and then stops, allowing for the string 34 to be unloaded, with the cycle repeated, and then the process can be repeated with another string.

An apparatus used in developing the present invention was Instron Model 3344 made by Instron Corporation, Norwood, Mass. All data presented herein were obtained with this apparatus using tension to provide stretch at the rate of 1 inch per minute.

Figure 2:
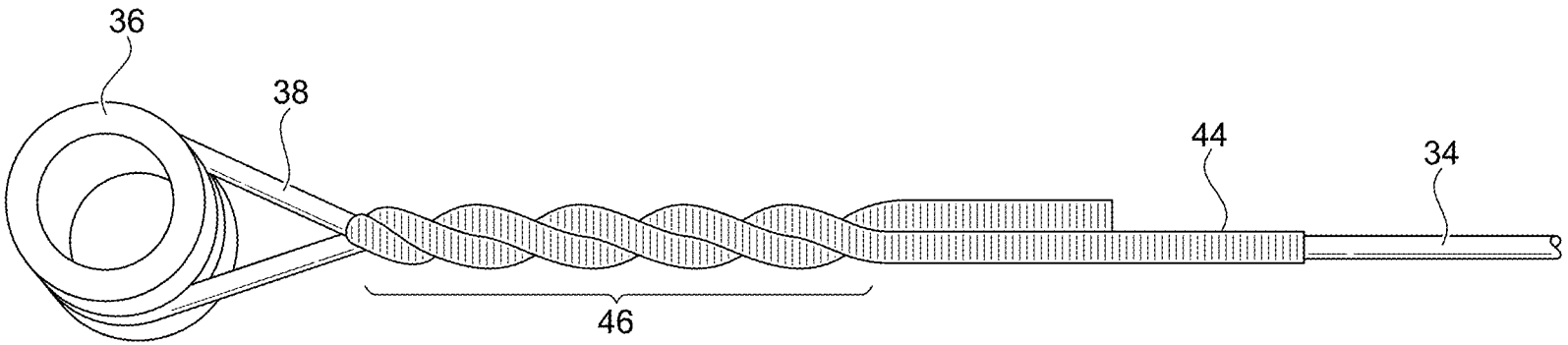
FIG. 2 is a perspective view of a portion of a musical string treated according to the present invention, the string having a retainer.

The present invention can be used with strings that are just plain strings or wires, or they can be provided with a retainer that is used to engage a musical instrument. Referring now to FIG. 2, there is shown a retainer that can be conventional ball 36 or loop secured to the string 34, or can be built into the string 34, such as forming a loop 38 with the string 34. The ball 36 shown in the Figures is conventionally referred to as a "ball" in the art, although in reality is an annulus rather than a sphere.

Figure 3:
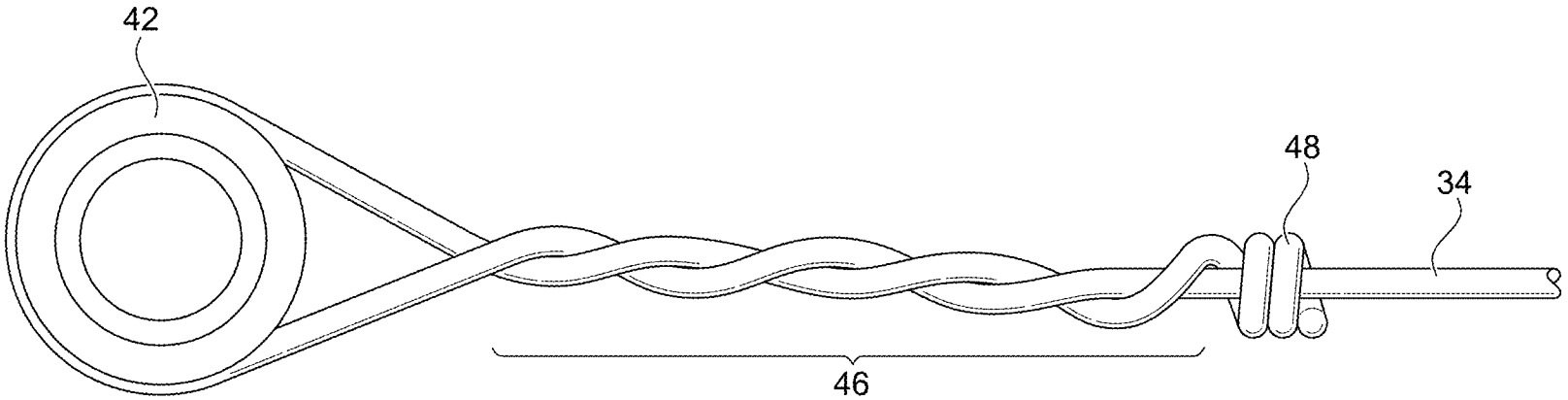
FIG. 3 is a top plan view of a portion of a musical string treated according to the present invention, the string having a retainer.

The string 34 can be a reinforced plain string as shown in FIG. 2 where a secondary reinforcement of wire 44 such as brass wire is wound around a twist 46 in the string 34 for securing the ball 36, providing added durability and stability. Optionally, the string 34 can be non-reinforced plain string as shown in FIG. 3. If the string is non-reinforced, there is typically a lock twist 48 that is used to secure the twist 46 in the string 34. The string 34 can be made of synthetic material or a metal. The invention is particularly useful for metal strings. The synthetic material is any synthetic material used for musical strings such as nylon, fluoropolymer such as polyvinylidene fluoride, carbon fiber, or composites. It can also be made from a combination of synthetic and metal and a combination of metals. The strings 34 can be straight metal string or stranded. For example, there can be a core made of synthetic filaments, solid metal, or braided or twisted steel filaments. The metals used can be steel, carbon steel, maraging steel, stainless steel, titanium, and aluminum, the steel typically being carbon steel. The string 34 can be plated or coated with materials such as with tin, zinc, brass, polymer, gold, nickel, and silver. These materials can be used for non-wound-strings and for wound strings. A classical guitar string can be made from a nylon multifilament core; similar to dental floss, and wound with brass or silver plated copper; they are considered non-metallic strings due to the core being non-metallic.

Typical sizes for the string 34 depend on whether they are wound or non-wound. A non-wound string typically has a diameter from 0.007 to 0.026 inch while a wound string typically has a diameter from 0.018 to 0.145 inch. A typical guitar string has a length of about 40 inches.

The preferred application for the invention is to use the invention with guitars including bass guitars and classical guitars. However, the invention can also be used with other stringed instruments such as a banjo, ukulele, violin, viola, bass, harp, and piano.

The invention has advantages as compared to typical method of tuning an instrument, where the musician tunes the string, one by one, after mounting on the apparatus. The use of a controllable apparatus, producing consistent and reproducible results is achieved. Moreover, it has been determined that if the string prepared according to the present invention goes out of tune, the amount it goes out of tune is less than typically occurs with the string if tuned on the instrument, and retuning is required less frequently. Thus, during a performance, it is less likely a string will go out of tune, and if it does go out of tune, the amount is less noticeable than occurs with strings tuned conventionally.

A 10-inch portion of five different guitar strings was stretched. The strings were:

1. 0.009" Standard Plain string with insufficient quantity of twists
2. 0.009" Standard Plain string with appropriate quantity of twists
3. 0.009" RPS reinforced with brass wire
4. 0.009" RPS reinforced with nickel plated steel wire
5. 0.009" RPS using high strength steel and reinforced with brass wire

TABLE 1

Results of testing five guitar strings according to the present invention

| | Elongation [%] | Tensile Stress at Maximum Force [ksi] | Maximum Force [lbf] | Force at Yield (Offset 0.2%) [lbf] |
|---|---|---|---|---|
| 1 | 1.85 | 265.66 | 16.90 | 14.37 |
| 2 | 1.87 | 369.31 | 23.49 | 21.58 |
| 3 | 2.50 | 397.68 | 25.30 | 23.94 |
| 4 | 2.47 | 397.80 | 25.31 | 24.42 |
| 5 | 2.47 | 434.57 | 27.65 | 26.11 |

Figure 4:
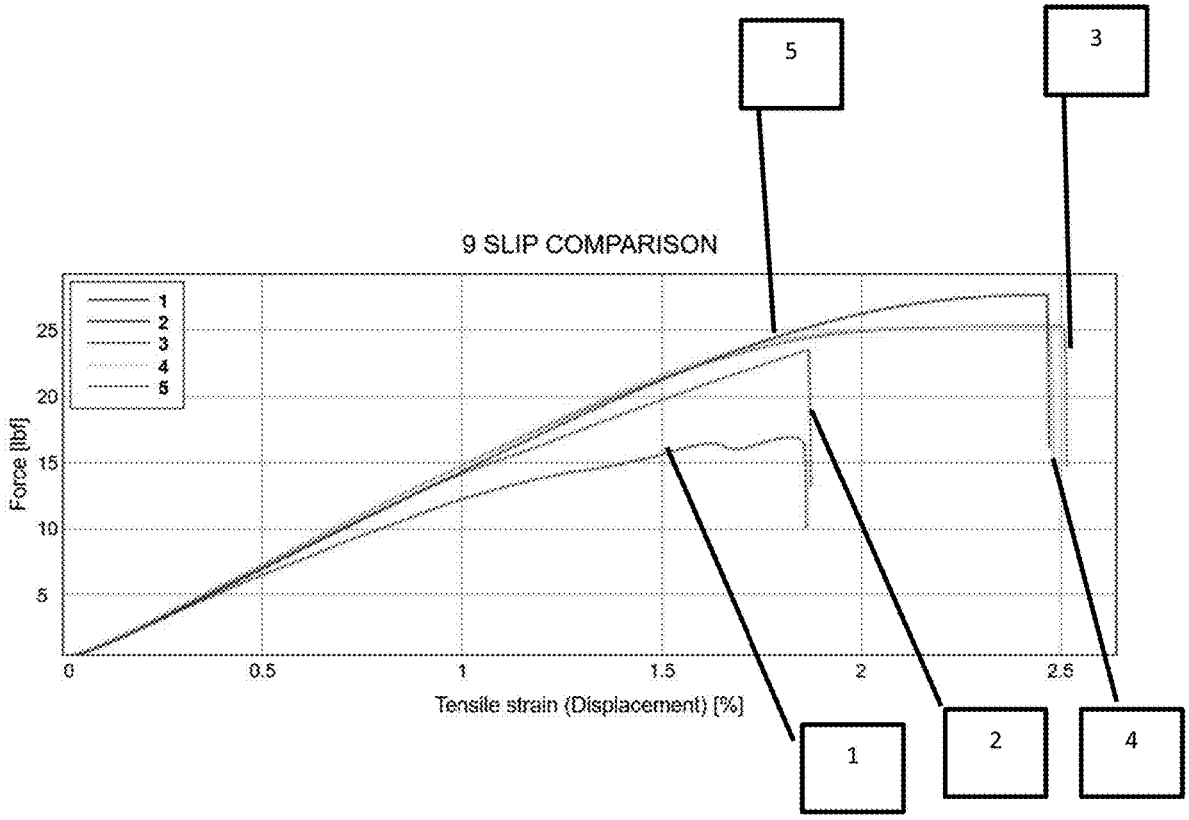
FIG. 4 is a graph showing results from testing the present invention.

Strings 1-4 used normal strength steel. For each stretch, the percent elongation, the tensile stress (thousand pounds per square inch) at maximum force, the maximum force exerted, and the force yield are reported. The strings were stretched to failure. The testing was done according to ASTM E8. FIG. 4 is a graph showing the tensile strain, or displacement, of strings 1-5.

TABLE 2

Results of testing one guitar string five times

| | Elongation [%] | Tensile Stress at Maximum Force [ksi] | Maximum Force [lbf] | Modulus (Automatic Young's) [ksi] |
|---|---|---|---|---|
| 1 | 1.34 | 990.33 | 63.00 | 76454.05 |
| 2 | 1.19 | 990.43 | 63.01 | 80940.69 |
| 3 | 1.18 | 990.53 | 63.01 | 81520.69 |
| 4 | 1.17 | 990.54 | 63.02 | 81810.11 |
| 5 | 1.17 | 990.30 | 63.00 | 82032.18 |

Figure 5:
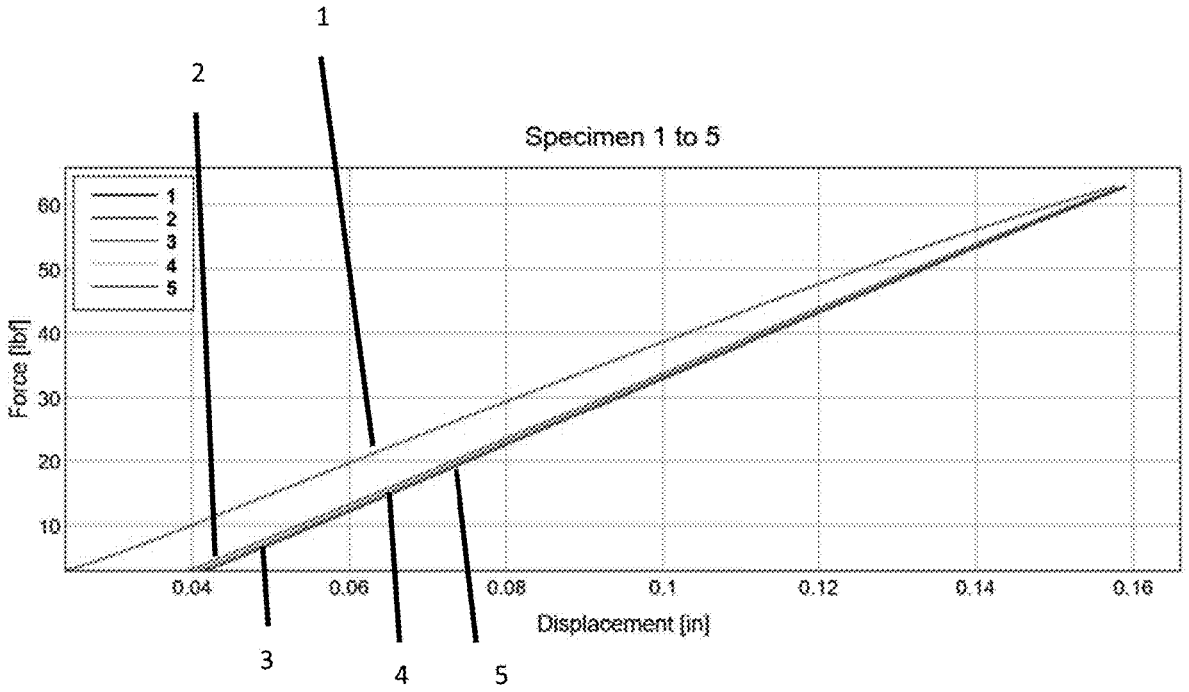
FIG. 5 is a graph showing results from testing the present invention.

Table 2 and FIG. 5 show the results of testing performed on a portion of a guitar string. The string tested was a guitar string having the configuration shown in FIG. 2, with an initial length of ten inches, diameter of 0.017 inch, and made of tin plated high carbon steel with an RPS (see below) construction. The string was stretched and released five times. The tension applied in each cycle was 90% of the maximum load, which is the amount of load that results in destruction of the string.

Table 2 reports percentage elongation at maximum force, calculated as maximum displacement as a percentage of the original string length. For example, stretch 1 of 1.34% is the amount of increase in length as a percentage of the length of the string before it was stretched. Stretch two in Table 2 of 1.19% is the percentage elongation from the stretch based on the length before stretch 1. In each of stretches 1-3, the string undergoes elastic stretch and permanent stretch, and typically the process is stopped as additional stressing results in minimal or no permanent stretch. In stretches 4 and 5 the stretch was all elastic; once the stress was released the string went back to it length before the stretch. Most of the permanent stretch occurs in stretch 1 with a displacement of 0.04 inch which is 0.4% of the original length. As particularly shown in Table 2 and FIG. 5, treatment of a musical string realizes diminishing improvement as the number of cycles is increased, and in this case, substantially no improvement was achieved beyond four cycles. Therefore; the number of cycles of stretch and release is at least 1, preferably from 2 to 6, and can be a maximum of 4.

The graph in FIG. 5 shows the amount of displacement in a 17-gauge string made of high carbon steel, tin plated, as a function of the pulling force on the string, and thus reports the increase in inches in the length of the string.

With reference to FIG. 6, the string tested was a guitar string having the configuration shown in FIG. 5, with an initial length of 10 inches, and the type, set, and gauge as shown in FIG. 6. FIG. 6 shows the effect of the amount of stretch on a string tested. The data shown in dark grey indicates when the extension was released, there was no permanent elongation achieved, and thus was considered ineffective for changing the stability of the string. Areas that are light grey or white, the tension resulted in a permanent stretching of the string.

One type of strings tested was metallic strings. "RPS" in the FIG. 6 denotes a reinforced plain string, which has a secondary reinforcement of wire 44 such as brass wound around the twist 46 for added durability and stability, as shown in FIG. 2

As shown in FIG. 3, a standard plain string is a non-wound string with a ball end twist 48 using only the plain string wire. It is not reinforced at the twist 46. The twist 46 is normally silver in color.

Standard electric guitar string wounds are wound strings consisting of a hexagonal core wire made from the same material as a plain string and wound with a softer nickel-plated steel wire. The second diameter listed in each row designation is the diameter of the hexagonal core. For example; 0.042 (0.017 hx) indicates that the wound string has an overall diameter of 0.042" and the diameter of the hexagonal core is 0.017", which is typical of electric guitar strings; classical plain string or non-wound strings are made of nylon monofilament.

The breaking load is the estimated force (pounds of force) to break the string under static load and the stretch percentages are a percentage of the breaking load force.

With regard to FIG. 7 and Table 3, calculations based on theoretical tuning tension are presented. 0.010-0.046" electric refers to largest and smallest diameter evaluated, wherein the first set of data in FIG. 7*a* shows the gauge was from 0.010 to 0.046 inch, and the scale length of the string was 25.5 inches, which is a common length used for guitars. Scale length is maximum vibrating length of the strings that produce sound. Typically, guitar scale lengths are about 23 inches to about 30 inches long.

The tuning tension is the pounds force applied at which a string achieves the appropriate pitch based on the string diameter and scale length, and the tuning percent is the tuning tension as a percentage of the breaking load.

results are achieved with this invention by repeated stretching to 80% or more of the breaking load, typically up to about six times.

FIG. 8 shows the results of testing similar to that reported in FIG. 5 with a 0.017" diameter guitar string. FIG. 8B is a portion of FIG. 8A to more clearly show the tensile strain that occurred with cycles 2-5.

TABLE 4

Summary of Testing Performed
Pre-Stretch Process for 5 Cycles at 90% of Max Load
Tensile Test
Guitar Hookend and Cord/Yarn Grip Fixtures
1 in/min Strain Rate

| | |
|---|---|
| Method description | Tensile Test<br>Guitar Hookend and Cord/Yarn Grip Fixtures<br>1 in/min Strain Rate |
| Sample description | Pre-Stretch Process for 5 Cycles at 90% of Max Load |
| Sample note 1 | .017" RPS |

.017" RPS

TABLE 3

Calculations based on theoretical tuning tension regarding guitar strings according to the present invention

| | Set | Gauge | Breaking Load | Tuning Tension | Tuning Percent | Ideal Stretch Percentages (lbs) - 5 Cycles Each | | | |
|---|---|---|---|---|---|---|---|---|---|
| | | | | | | 80% | 85% | 90% | 95% |
| Metallic Strings | 10-46 | .010 | 29 | 17.6 | 60.7% | 23.2 | 24.7 | 26.1 | 27.6 |
| | Electric 25.5" | .013 | 44 | 15.2 | 34.5% | 35.2 | 37.4 | 39.6 | 41.8 |
| | Scale Length | .017 | 70 | 16.6 | 23.7% | 56.0 | 59.5 | 63.0 | 66.5 |
| | Standard | .026 (.014hx) | 51 | 18.9 | 37.1% | 40.8 | 43.4 | 45.9 | 48.5 |
| | Tuning | .036 (.015hx) | 59 | 19.8 | 33.6% | 47.2 | 50.2 | 53.1 | 56.1 |
| | | .046 (.017hx) | 77 | 17.8 | 23.1% | 61.6 | 65.5 | 69.3 | 73.2 |
| | 9-42 | .009 | 21 | 13.2 | 62.9% | 16.8 | 17.9 | 18.9 | 20.0 |
| | Electric 25.5" | .011 | 32 | 11.9 | 37.2% | 25.6 | 27.2 | 28.8 | 30.4 |
| | Scale Length | .016 | 62 | 14.7 | 23.7% | 49.6 | 52.7 | 55.8 | 58.9 |
| | Standard | .024 (.013hx) | 45 | 15.7 | 34.9% | 36.0 | 38.3 | 40.5 | 42.8 |
| | Tuning | .032 (.015hx) | 59 | 15.7 | 26.6% | 47.2 | 50.2 | 53.1 | 56.1 |
| | | .042 (.017hx) | 77 | 15 | 19.5% | 61.6 | 65.5 | 69.3 | 73.2 |
| | 11-52 | 11 | 32 | 21.2 | 66.3% | 25.6 | 27.2 | 28.8 | 30.4 |
| | Acoustic 25.5" | 15 | 59 | 20.5 | 34.7% | 47.2 | 50.2 | 53.1 | 56.1 |
| | Scale Length | 22w (.013hx) | 45 | 26.6 | 59.1% | 36.0 | 38.3 | 40.5 | 42.8 |
| | Standard | 30 (.015hx) | 59 | 28 | 47.5% | 47.2 | 50.2 | 53.1 | 56.1 |
| | Tuning | 42 (.016hx) | 69 | 30.2 | 43.8% | 55.2 | 58.7 | 62.1 | 65.6 |
| | | 52 (.018hx) | 93 | 26.2 | 28.2% | 74.4 | 79.1 | 83.7 | 88.4 |
| Non-Metallic Strings | 28-42 | 28 | 20 | 16.2 | 81.0% | 16.0 | 17.0 | 18.0 | 19.0 |
| | Classical 25.5" | 32 | 20 | 12 | 60.0% | 16.0 | 17.0 | 18.0 | 19.0 |
| | Scale Length | 40 | 20 | 11.9 | 59.5% | 16.0 | 17.0 | 18.0 | 19.0 |
| | Standard | 30 | 40 | 12.4 | 31.0% | 32.0 | 34.0 | 36.0 | 38.0 |
| | Tuning | 36 | 40 | 13.9 | 34.8% | 32.0 | 34.0 | 36.0 | 38.0 |
| | | 42 | 40 | 14.7 | 36.8% | 32.0 | 34.0 | 36.0 | 38.0 |

With regard to the graphs in FIGS. 7*a*-7*d*, A440 refers to the frequency at which the tuning tensions are based on. It represents the frequency of 440 hertz which is the musical note of A above middle C and is used as a general tuning standard for musical pitch. The graphs in FIGS. 7*a*-7*d* show the theoretical tuning tension based on the gauges of the strings; the frequency to which each string would be tuned, and a common scale length for each instrument.

More specifically, the bar graphs in FIGS. 7*a*-7*d* show the breaking load (element 1) as reported in Table 3, the tension applied (element 2) as reported in Table 3, an "ideal" or "preferred" stretch (element 3) which is estimated to be 80% or more of the breaking load. It is believed that optimum

TABLE 5

Summary of Results of Testing

| | Elongation [%] | Maximum Force [lbf] | Tensile stress at Break (Standard) [ksi] |
|---|---|---|---|
| 1 | 1.338 | 63.00 | 277.57 |
| 2 | 1.191 | 63.01 | 277.59 |
| 3 | 1.180 | 63.01 | 277.62 |
| 4 | 1.174 | 63.02 | 277.63 |
| 5 | 1.170 | 63.00 | 277.56 |

After one or multiple strings are tuned, they can be applied to the instrument, such as to a guitar, by conventional means. Preferably all strings in the instrument are treated according to this invention; however, the invention is useful even if only one string is treated.

What is claimed is:

1. A method of treating an instrument string comprising the steps of:

(a) securing both ends of the string, while the string is not on an instrument, to an apparatus that can apply tension to the string, the string having a longitudinal axis;

(b) applying sufficient tension to the string with the apparatus along the longitudinal axis of the string to elongate the string by at least 0.3% without breaking the string; and (c) releasing at least part of the tension of step (b), wherein at least part of the elongation from step (b) remains.

2. The method of claim 1, wherein steps (b) and (c) are performed at least twice.

3. The method of claim 2, wherein steps (b) and (c) are performed two to six times.

4. The method of claim 1, wherein the string has a retainer proximate to one end.

5. The method of claim 4, wherein the retainer is a ball.

6. The method of claim 1, wherein in step (b) tension is applied only along the longitudinal axis of the string.

7. The method of claim 1, wherein the step of applying sufficient tension comprises applying tension at a rate to achieve elongation at a rate of 0.1-10 inches/minute.

8. The method of claim 7, wherein the step of applying sufficient tension comprises applying tension at a rate to achieve elongation at a rate of about 1 inch/minute.

9. A method of treating an instrument string comprising the steps of:

(a) securing both ends of the string, while the string is not on an instrument, to an apparatus that can apply tension to the string, the string having a longitudinal axis;

(b) applying sufficient tension to the string with the apparatus along the longitudinal axis of the string to achieve a stretch of at least 30% of the maximum stretch achievable before failure of the string; and (c) releasing at least part of the tension of step (b), wherein at least part of the elongation from step (b) remains.

10. The method of claim 1 wherein the step of applying sufficient tension comprises achieving a stretch of at least 30% of the maximum stretch achievable before failure of the string.

11. The method of claim 10, wherein the step of applying sufficient tension comprises achieving a stretch no more than 95% of the maximum stretch achievable before failure of the string.

12. The method of claim 10, wherein the step of applying sufficient tension comprises achieving a stretch of at least 65% of the maximum stretch achievable before failure of the string.

13. The method of claim 1, wherein step (c) comprises releasing substantially all the tension.

14. The method of claim 1, wherein in the string comprises metal.

15. The method of claim 1, wherein the string comprises synthetic material.

16. A string for a musical instrument, the string prepared by the method of (a) securing both ends of the string, while the string is not on an instrument, to an apparatus that can apply tension to the string, the string having a longitudinal axis;

(b) applying sufficient tension to the string with the apparatus along the longitudinal axis of the string to elongate the string by at least 0.3% without breaking the string; and (c) releasing at least part of the tension of step (b), wherein at least part of the elongation from step (b) remains.

17. A musical device having a string having a longitudinal axis, the string being strung on the device, wherein the string was prepared by the steps of:

(a) securing both ends of the string, while the string is not on any musical instrument, to an apparatus that can apply tension to the string, the string having a longitudinal axis;

(b) applying sufficient tension to the string with the apparatus along the longitudinal axis of the string to elongate the string by at least 0.3% without breaking the string; and (c) releasing at least part of the tension of step (b), wherein at least part of the elongation from step (b) remains.

18. The method of claim 1, comprising, after step (c), the step, of (d) stringing a musical instrument with the string.

19. The method of claim 1, where the string is a non-wound string having a diameter of from 0.007-0.026 inch.

20. The method of claim 1, where the string is a wound string having a diameter of from 0.018-0.145 inch.

21. The method of claim 1, wherein step (b) comprises applying sufficient tension to the string with the apparatus along the longitudinal axis of the string to elongate the string by at least 1%.

22. A method of treating an instrument string, the string having a longitudinal axis and a maximum stretch achievable before failure of the string, the method comprising the steps of:

(a) securing both ends of the string, while the string is not on an instrument, to an apparatus that can apply tension to the string along the longitudinal axis of the string;

(b) after step (a) elongating the string by at least 30% of the maximum stretch achievable before failure of the string; and (c) releasing at least part of the tension of step (b), wherein at least part of the elongation from step (b) remains.

23. The method of claim 22, wherein the string comprises a combination of metal and synthetic.

24. The musical instrument of claim 17 wherein the string comprises metal.

25. A method of treating an instrument string comprising the steps of:

(a) securing both ends of the string, while the string is not on an instrument, to an apparatus that can apply tension to the string, the string having a longitudinal axis;

(b) applying sufficient tension at a rate of 0.1-10 inches/minute to the string with the apparatus only along the longitudinal axis of the string to achieve a stretch of at least 65% of the maximum stretch achievable before failure of the string, wherein the string is elongated by at least 0.3%;

(c) releasing at least part of the tension of step (b), wherein at least part of the elongation from step (b) remains; and (d) repeating steps (b) and (c) at least one more time.

* * * * *